US006200232B1

(12) United States Patent
Kasashima et al.

(10) Patent No.: US 6,200,232 B1
(45) Date of Patent: Mar. 13, 2001

(54) GOLF BALL AND METHOD OF ARRANGING DIMPLES THERETO

(75) Inventors: Atsuki Kasashima; Keisuke Ihara; Hirotaka Shimosaka; Yutaka Masutani; Michio Inoue, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/396,798

(22) Filed: Sep. 15, 1999

Related U.S. Application Data

(63) Continuation-in-part of application No. 09/097,700, filed on Jun. 16, 1998, now abandoned.

(30) Foreign Application Priority Data

Jun. 17, 1998 (JP) ..... 9-176399

(51) Int. Cl.[7] ..... A63B 37/14

(52) U.S. Cl. ..... 473/384; 473/383; 473/379; 473/381; 473/382

(58) Field of Search ..... 473/378–384

(56) References Cited

U.S. PATENT DOCUMENTS

| | | | | |
|---|---|---|---|---|
| 4,915,389 | | 4/1990 | Ihara | 273/232 |
| 4,925,193 | | 5/1990 | Melvin et al. | 273/232 |
| 5,192,078 | | 3/1993 | Woo | 273/232 |
| 5,249,804 | * | 10/1993 | Sanchez | 473/379 |
| 5,827,135 | | 10/1998 | Shimosaka et al. | 473/379 |
| 5,902,193 | * | 5/1999 | Shimosaka et al. | 473/384 |
| 5,906,551 | * | 5/1999 | Kasashima et al. | 473/384 |

* cited by examiner

*Primary Examiner*—Mark S. Graham
*Assistant Examiner*—Raeann Gordon
(74) *Attorney, Agent, or Firm*—Sughrue, Mion, Zinn, Macpeak & Seas, PLLC

(57) ABSTRACT

A golf ball is molded in a mold comprising a pair of removably joined mold sections. The golf ball has a plurality of dimples, the dimples being arranged in a polyhedral arrangement. The golf ball is free of a great circle which does not intersect with the dimples. The dimples ($D_2$) lying across the parting line (P) between the mold sections, except for the dimples ($D_1$) whose center lies on the parting line, are shifted upward or downward from the parting line or reduced in diameter so that these dimples are located outside the parting line (P). The dimple surface coverage is at least 71%. A golf ball having high symmetry and excellent flight performance can be prepared using a simple mold.

18 Claims, 8 Drawing Sheets

GOLF BALL AND METHOD OF ARRANGING DIMPLES THERETO

CROSS REFERENCE TO RELATED APPLICATION

This application is a continuation-in-part of application Ser. No. 09/097,700 filed on Jun. 16, 1998 now abandoned, the entire contents of which are hereby incorporated by reference.

BACKGROUND OF THE INVENTION

1. Field of the Invention

This invention relates to a dimpled golf ball free of a great circle which does not intersect with the dimples and having high symmetry. It also relates to a method of arranging dimples to the surface of a golf ball.

2. Prior Art

The flight performance of golf balls is greatly affected by the arrangement and configuration (including diameter, depth and cross-sectional shape) of dimples. Various dimple arrangements are known in the art for arranging a plurality of dimples on the ball surface in an even or dense fashion. Typical known dimple arrangements are polyhedral arrangements including octahedral, cubic-octahedral, dodecahedral and icosahedral arrangements.

JP-B 7875/1994 attemps to tailor the dimple configuration such that the overall effective volume of dimples remains substantially equal between pole hitting (the spin axis is in the equator plane) and seam hitting (the spin axis is a pole-to-pole line).

Golf balls are generally molded in an axisymmetric manner by using a mold comprising a pair of mold halves, removably mating them along a parting line to define a spherical cavity therein, and introducing stock material into the cavity. The thus molded golf balls tend to have a higher degree of roundness or spherically about a pole-to-pole axis corresponding to a line connecting the apexes of the mold half cavities, but a lower degree of roundness about an axis on a plane circumscribed by a seam line corresponding to the parting plane of the mold. Because of such variation in roundness, conventional golf balls exhibit different flight performance depending on the position at which the ball is hit. Such flight performance variation raises a serious problem in the game of golf wherein the Rules of Golf prescribe that "the ball shall be played as it lies, except as otherwise provided in the Rules."

More specifically, when a golf ball is hit by a club, the ball is given back spin although the number of revolutions varies with a particular type of club. The hitting of the ball is generally classified into pole hitting and seam hitting depending on an impact point. Reference is now made to FIGS. 8(A) and 8(B) wherein a golf ball 11 has a seam line 12 and a center 16. The term "pole hitting" means that the ball 11 is hit at arrow 20 to give back spin about a straight line 18 connecting two diametrically opposed points 14, 14 on the seam line 12 and the center 16 as shown in FIG. 8(A). The term "seam hitting" means that the ball 11 is hit at arrow 26 to give back spin about a straight line 24 extending perpendicular to a circular plane 22 circumscribed by the seam line 12 and passing the center 16 as shown in FIG. 8(B). As previously mentioned, in the event of pole hitting shown in FIG. 8(A), the ball is susceptible to extra lift or drag since it does not define a true circle about the spin axis 18. On the other hand, in the event of seam hitting shown in FIG. 8(B), the ball is substantially free of extra lift or drag since it is close to a true circle about the spin axis 24. As a consequence, if the ball is simply designed such that the effect of dimples may be equal between pole hitting and seam hitting, the effect of dimples would be greater upon pole hitting because of a deviation from roundness. Then on pole hitting, the golf ball receives extra lift or drag, exhibiting different flight performance than on seam hitting. This means that the flight performance varies with respect to a particular position where the golf ball is hit.

To produce a golf ball which is improved in symmetry in that the flight performance remains constant regardless of a particular hit position, the arrangement and configuration of dimples must be designed in consideration of the shape or roundness of the ball to optimize the effect of dimples. This requirement has not been fully satisfied.

SUMMARY OF THE INVENTION

Therefore, an object of the present invention is to provide a golf ball having dimples in an octahedral, dodecahedral or icosahedral arrangement which is improved in symmetry in that the ball will follow the same trajectory on either seam hitting or pole hitting, that is, the flight performance does not vary with a particular hit position and which can be conveniently molded using a split mold.

Another object of the present invention is to provide a method of arranging dimples on the surface of a golf ball to improve symmetry.

According to one aspect of the present invention, there is provided a golf ball which is molded in a mold comprising a pair of mold sections which are removably joined to define a spherical cavity therein whereby the golf ball has a parting line at the junction between the mold sections, the golf ball having two to six types of dimples having different diameters within a range of 1.8 to 5 mm on the surface thereof, the dimples being arranged in a polyhedral arrangement selected from octahedral, dodecahedral and icosahedral arrangements so that the golf ball is free of a great circle which does not intersect with the dimples and some of the dimples lie across the parting line, wherein off-center-crossing dimples which lie across the parting line and whose center lies outside the parting line are shifted upward or downward from the parting line or reduced in diameter so that the off-center-crossing dimples do not lie across the parting line, while center-crossing dimples whose center lies on the parting line are kept unchanged, and the surface coverage of dimples is at least 71%.

According to another aspect of the present invention, there is provided a method of arranging two to six types of dimples having different diameters within a range of 1.8 to 5 mm on the surface of a golf ball which is molded in a mold comprising a pair of mold sections which are removably joined to define a spherical cavity therein so that the surface coverage of the dimples is at least 71%, the golf ball having a parting line formed at the junction between the mold sections and some of the dimples lying across the parting line, the method comprising arranging the dimples in a polyhedral arrangement selected from octahedral, dodecahedral and icosahedral arrangements so that the golf ball is free of a great circle which does not intersect with the dimples, and shifting off-center-crossing dimples which lie across the parting line and whose center lies outside the parting line upward or downward from the parting line or reducing the off-center-crossing dimples in diameter so that the off-center-crossing dimples do not lie across the parting line, while center-crossing dimples whose center lies on the parting line are kept unchanged.

A variety of golf balls having dimples lying across the parting line and free of a great circle which does not intersect with the dimples are known in the art. These balls are believed to have higher symmetry than golf balls having no dimples lying across the parting line. On the other hand, the symmetry of these balls also depends on the dimple arrangement. From the standpoint of symmetry, octahedral, dodecahedral and icosahedral arrangements are appropriate. When dimples are arranged in a polyhedral arrangement in the prior art, it is a common practice to arrange the dimples so that they may not lie across the parting line.

From the above viewpoint, if dimples are distributed according to the polyhedral arrangement to achieve a high degree of symmetry while increasing the number or diameter of dimples so that the surface coverage of the dimples may be 71% or more, then the number of dimples lying across the parting line becomes as many as 20 or more. For molding such golf balls having dimples lying across the parting line using a split mold, there are known several techniques. For example, parting surfaces of upper and lower mold sections are corrugated at positions where the crossing dimples are to be formed, and dimple-forming protrusions are provided on the inner surface of the convex corrugations; or parting surfaces of upper and lower mold sections are formed with grooves where dimple-forming pins are buried. However, as the number of dimples lying across the parting line increases as mentioned just above, the corresponding mold becomes more complex and cumbersome to manufacture and hence, expensive, and gives rise to a problem of strength. If dimples are distributed according to the polyhedral arrangement while the number of dimples lying across the parting line is limited to less than 20, then the location of dimples is somewhat restricted and consequently, the surface coverage of dimples is reduced, giving rise to a shortage of distance.

Making investigations to solve the above problems, the inventors have found the following relationships. To achieve a dimple arrangement providing a dimple surface coverage of at least 71% sufficient to ensure high symmetry and a flight distance, the inventors attempted a polyhedral arrangement regardless of the number of dimples lying across the parting line. The dimples lying across the parting line includes the dimples whose center lies on the parting line (referred to as center-crossing dimples) and the dimples which lie across the parting line outside their center (referred to as off-center-crossing dimples). Even in the event where the number of dimples lying across the parting line is more than 20, if the location of the off-center-crossing dimples is shifted upward or downward from the parting line or the diameter of the off-center-crossing dimples is reduced so that these dimples may not lie across the parting line, then there is obtained a golf ball which is improved in symmetry so that no substantial difference in spin rate and launch angle may occur between seam hitting and pole hitting, although the dimple arrangement slightly deviates from the exact polyhedral arrangement due to the shifting or diameter reduction of the off-center-crossing dimples. Even when the total number of dimples lying across the parting line is more than 20, by restricting the number of center-crossing dimples to 20 or less, the degree of freedom of dimple arrangement is improved so that a golf ball satisfying the symmetry and flight distance may be obtained. In addition, the number of dimples lying across the parting line becomes equal to the number of center-crossing dimples as a result of shifting or diameter reduction, which is advantageous from the standpoint of mold manufacture.

Accordingly, the golf ball of the invention has high symmetry and excellent flight performance which remains substantially identical between seam hitting and pole hitting, and can be advantageously molded using a mold which is easy and inexpensive to manufacture and has a sufficient strength.

BRIEF DESCRIPTION OF THE DRAWINGS

These and further features of the present invention will be apparent with reference to the following description and drawings, wherein:

FIG. 3 schematically illustrates the dimples arranged on a golf ball, wherein

DETAILED DESCRIPTION OF THE INVENTION

Figure 1:
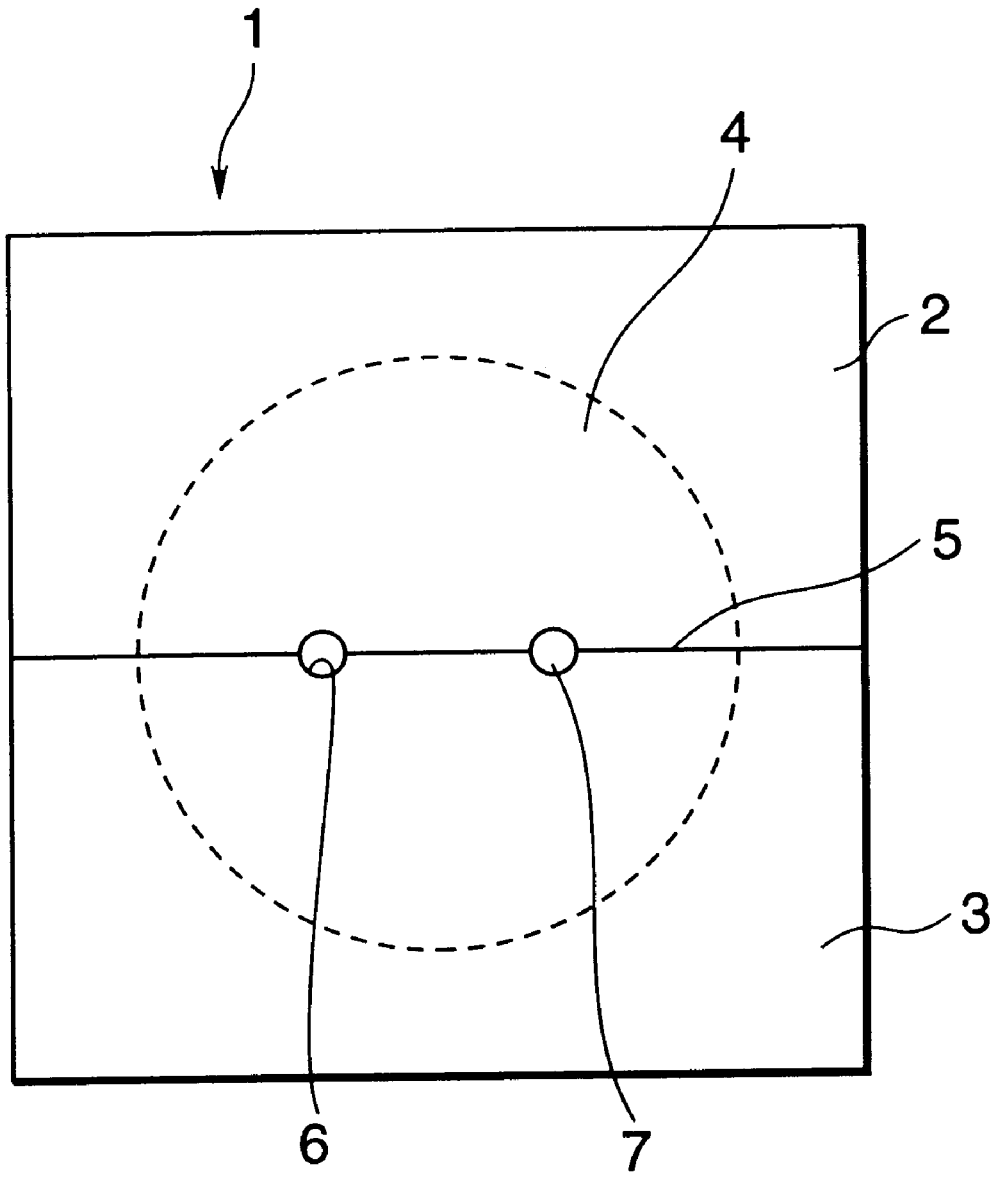
FIG. 1 is a front view of one embodiment of a mold used in the invention.

The golf ball of the present invention is molded, as shown in FIG. 1, in a mold 1 comprising a pair of mold sections 2 and 3 which are removably mated or joined to define a spherical cavity 4 therein, and has a parting line 5 formed at the junction between the mold sections 2 and 3. The golf ball has a plurality of dimples formed on its surface, some of which lie across the parting line. The dimples are arranged in a polyhedral arrangement selected from octahedral, dodecahedral and icosahedral arrangements. The golf ball is free of a great circle which does not intersect with the dimples.

The distribution of dimples in a polyhedral arrangement selected from octahedral, dodecahedral and icosahedral arrangements can be carried out by well-known methods. According to the invention, the surface coverage of dimples should be at least 71%, preferably 73 to 85%, and more preferably 74 to 82%. With a dimple surface coverage of less than 71%, the flight performance becomes poor. The dimple surface coverage is defined, provided that the ball is a sphere having an imaginary spherical surface, as the sum of the surface areas of this imaginary sphere delimited by the edges of the individual dimples divided by the entire surface area of the imaginary sphere.

In the invention, the dimples preferably have a circular planar shape. The dimples have a diameter of 1.8 to 5 mm, and especially 2.3 to 4.5 mm. The depth of the dimples is preferably 0.05 to 0.3 mm, and especially 0.09 to 0.25 mm. It is preferred that the center-crossing dimples have a diameter of 2 to 5 mm, and especially 3 to 4 mm, and a depth of 0.1 to 0.3 mm, and especially 0.13 to 0.25 mm.

The dimples are two to six types which are different in diameter. It is preferred to arrange dimples of two to four types, especially three to four types, which are different in diameter. The total number of dimples is preferably 300 to 600, more preferably 350 to 550, and most preferably 372 to 500, from the standpoint of providing the above-defined dimple surface coverage.

In the present invention, the dimples are distributed according to the octahedral, dodecahedral or icosahedral arrangement such that a great circle which does not intersect with the dimples does not exist. No essential consideration need be made on the number of dimples lying across the parting line formed at the junction between the mold sections. Dimples are preferably arranged such that the number of center-crossing dimples (that is, dimples whose center lies on the parting line) is 4 to 20, more preferably 4 to 16, and most preferably 6 to 12 while the number of off-center-crossing dimples need not be taken into account.

Figure 2:
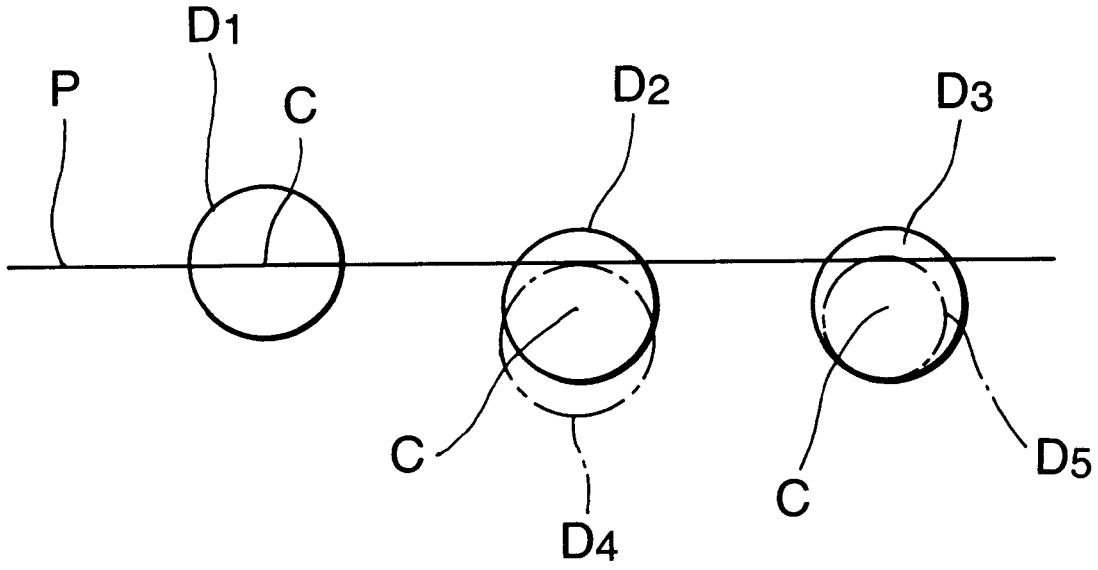
FIG. 2 is a plan view of dimples lying across the parting line.

Next, referring to FIG. 2, the feature of the invention is described. Among the dimples lying across the parting line P, center-crossing dimples $D_1$, that is, dimples whose center C lies on the parting line P are kept unchanged, and off-center-crossing dimples $D_2$, that is, dimples whose center C lies outside the parting line P are shifted upward or downward from the parting line P or off-center-crossing dimples $D_3$ are reduced in diameter. As a result these dimples $D_2$ and $D_3$ do not lie across the parting line P, that is, the intersection of the dimples with the parting line is canceled. The dimples having canceled the intersection with the parting line are depicted by phantom lines and designated $D_4$ and $D_5$. It is also acceptable that the off-center-crossing dimples $D_2$ or $D_3$ are shifted upward or downward from the parting line P and reduced in diameter at the same time.

In the present invention, the center of the center-crossing dimple lies substantially on the parting line. The off-center-crossing dimple is shifted upward in FIG. 2 from the parting line if the center of the off-center-crossing dimple lies above the parting line. The off-center-crossing dimple is shifted downward in FIG. 2 from the parting line if the center of the off-center-crossing dimple lies under the parting line. Further, if the off-center-crossing dimple is overlapped with the other dimple when it is shifted upward or downward from the parting line, the off-center-crossing dimple should be reduced in diameter. Thus, the off-center-crossing dimples are shifted upward or downward from the parting line and/or reduced in diameter so that they are not overlapped with the other dimples.

The transferred or diminished dimples which have been shifted upward or downward from the parting line or reduced in diameter so that they do not lie across the parting line stand adjacent to the parting line. More specifically, the transferred or diminished dimples stand within 0.5 mm apart from the parting line. Preferably, the transferred or diminished dimples are substantially tangent to the parting line.

It is understood that the parting line or great circle which does not intersect with a dimple is a line or circle which does not traverse a dimple. In this sense, the dimple which is tangent to the parting line or great circle is considered as a dimple which does not lie across the parting line or great circle.

Figure 3A:
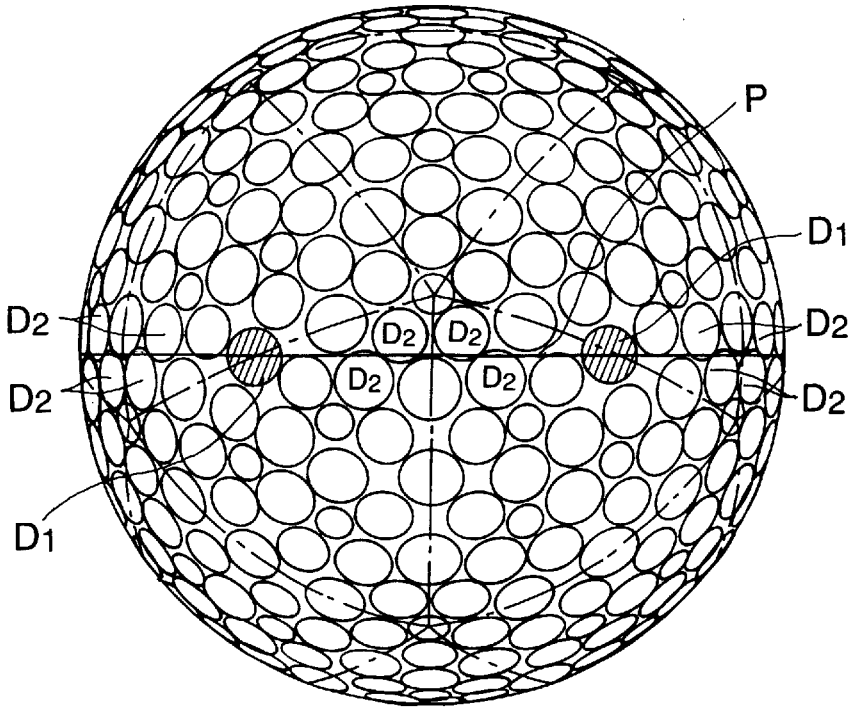
FIG. 3(A) shows the dimple arrangement before the adjustment according to the invention and FIG. 3(B) shows the dimple arrangement after the adjustment according to the invention.
Figure 3B:
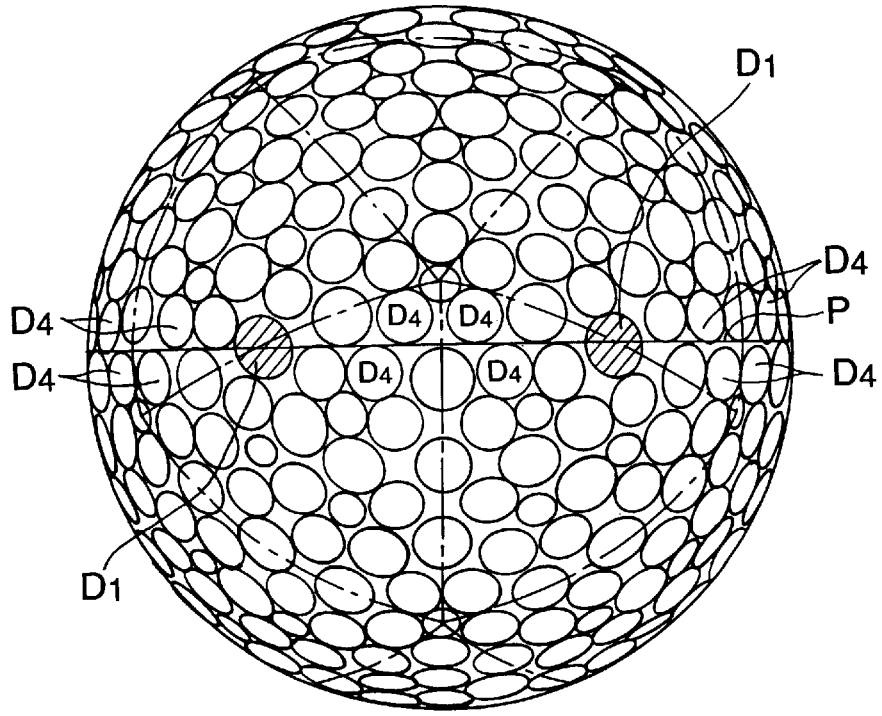

FIGS. 3(A) and 3(B) illustrate one example of the dimple arrangement according to the present invention. The golf ball of FIGS. 3(A) and 3(B) has dimples in a regular icosahedral arrangement. In FIGS. 3(A) and 3(B), spherical triangle units of the regular icosahedral arrangement are shown by dotted lines. FIG. 3(A) shows the dimple arrangement before the off-center-crossing dimples $D_2$ are not shifted upward or downward from the parting line P. FIG. 3(B) shows the dimple arrangement after the off-center-crossing dimples $D_2$ are shifted upward or downward from the parting line P so that they do not lie across the parting line P (they exist as the dimples $D_4$), while the center-crossing dimples $D_1$ are kept unchanged.

According to the invention, with respect to the parting line P, the center-crossing dimples $D_1$ are kept at the same position and the off-center-crossing dimples $D_2$ are shifted above or below the parting line P or reduced in diameter so that these dimples $D_2$ do not lie across the parting line P.

After the adjustment according to the invention, the number of dimples lying across the parting line is preferably 4 to 20, more preferably 4 to 16, and most preferably 6 to 12. A smaller number of such dimples would lead to a decline of symmetry whereas a larger number of such dimples require a corresponding larger number of grooves for receiving dimple-forming pins to be formed in the mold sections, which can reduce the strength of the mold.

As explained above and shown in FIG. 1, the golf ball of the invention is typically molded using a mold 1 comprising a pair of mold half sections 2 and 3 which are removably joined at their junction surfaces to define a spherical cavity 4 therein. The cavity surface of each mold section is formed with dimple-forming protrusions at positions corresponding to the positions where dimples are to be located, except for the center-crossing dimples on the parting line. For the center-crossing dimples on the parting line 5, radial grooves 6 are formed in one or both of the junction surfaces of the mold sections and dimple-forming pins 7 are received in the grooves.

Insofar as the dimple design satisfies the above-mentioned requirement, the golf ball of the invention may have any desired structure. The invention is applicable to solid golf balls including one-piece golf balls, two-piece golf balls, and multi-piece golf balls of three or more layer structure as well as wound golf balls. These golf balls can be prepared from well-known stock materials by conventional methods. The diameter and weight of the golf ball may be properly determined in accordance with the Rules of Golf.

There has been described a golf ball which has high symmetry and an increased dimple surface coverage and ensures excellent directional flight and distance, and which can be advantageously molded using a mold of simple structure.

EXAMPLE

Examples of the invention are given below by way of illustration and not by way of limitation.

On two-piece solid golf balls of the large size (diameter 42.67 mm and weight 45.2 grams), circular dimples were arranged as shown in FIGS. 4 to 7. The arrangement, surface coverage, and other parameters of dimples are shown below.

Example 1

Figure 4:
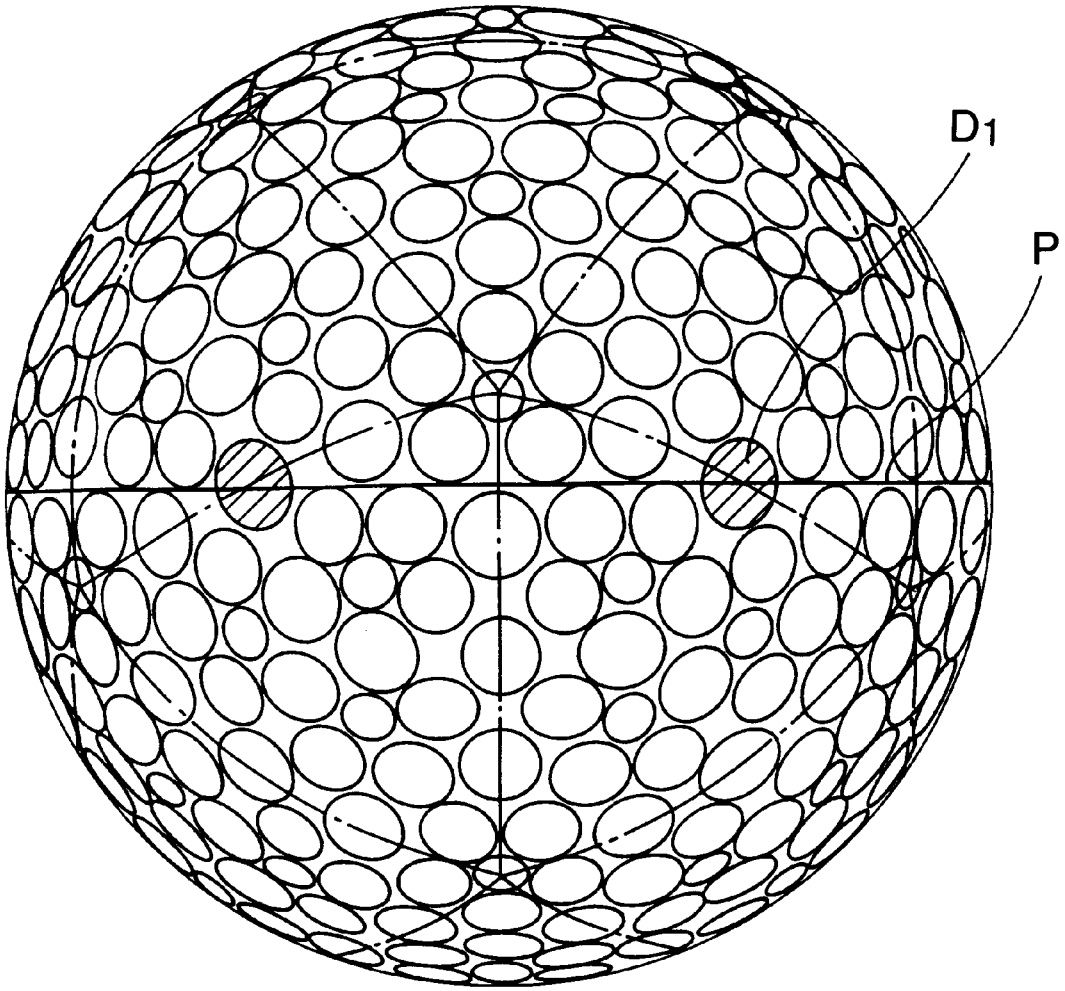
FIG. 4 schematically illustrates the dimples arranged on a golf ball according to one embodiment of the invention.

Arrangement: icosahedral, FIG. 4

Total number of dimples: 462

Type of dimples: 4 types

Diameter: 2.4 mm, 3.4 mm, 3.6 mm and 3.8 mm

Number of center crossing dimples ($D_1$: diameter 3.8 mm): 6

Dimple surface coverage: 75%

Example 2

Figure 5:
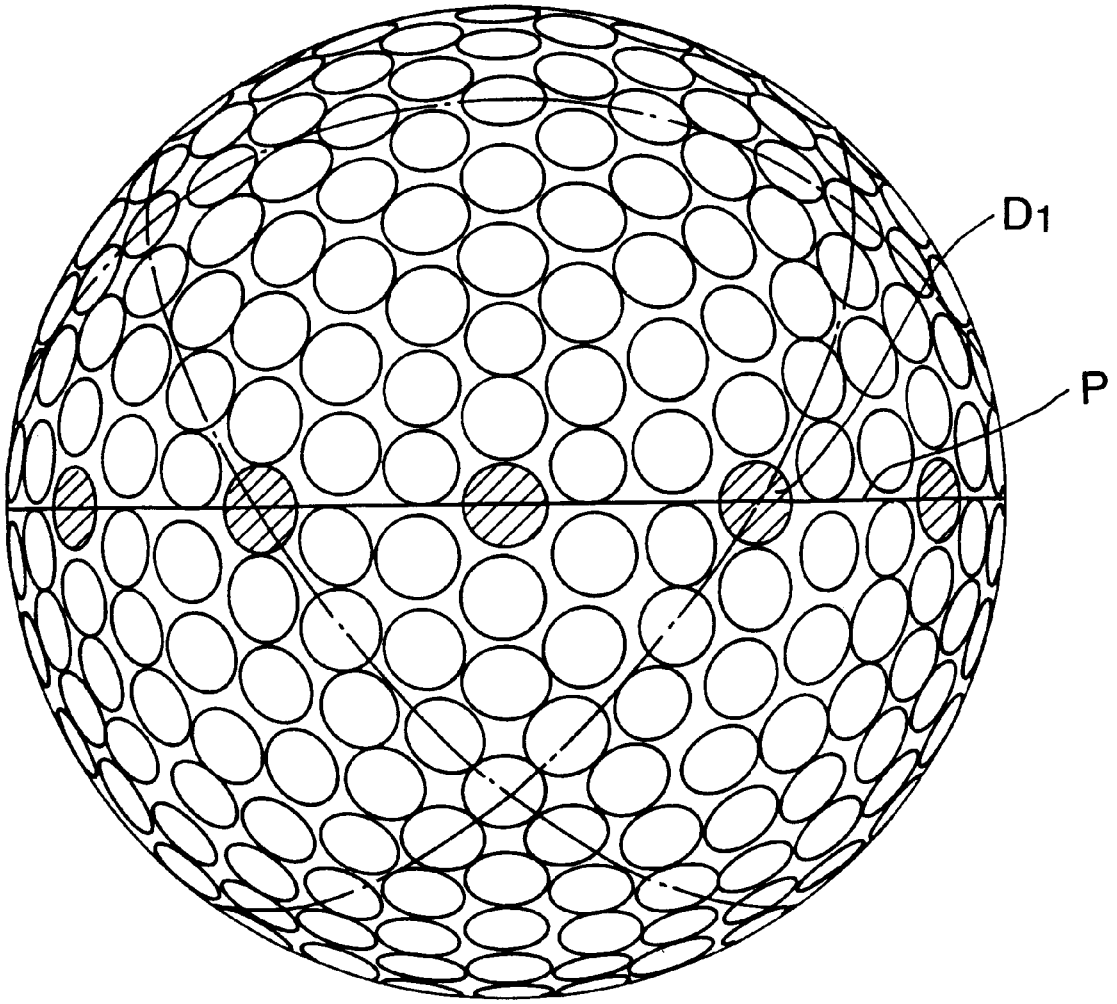
FIG. 5 schematically illustrates the dimples arranged on a golf ball according to another embodiment of the invention.

Arrangement: octahedral, FIG. 5

Total number of dimples: 406

Type of dimples: 2 types

Diameter: 3.3 mm and 3.7 mm

Number of center crossing dimples ($D_1$: diameter 3.7 mm): 12

Dimple surface coverage: 75%

Comparative Example 1

Figure 6:
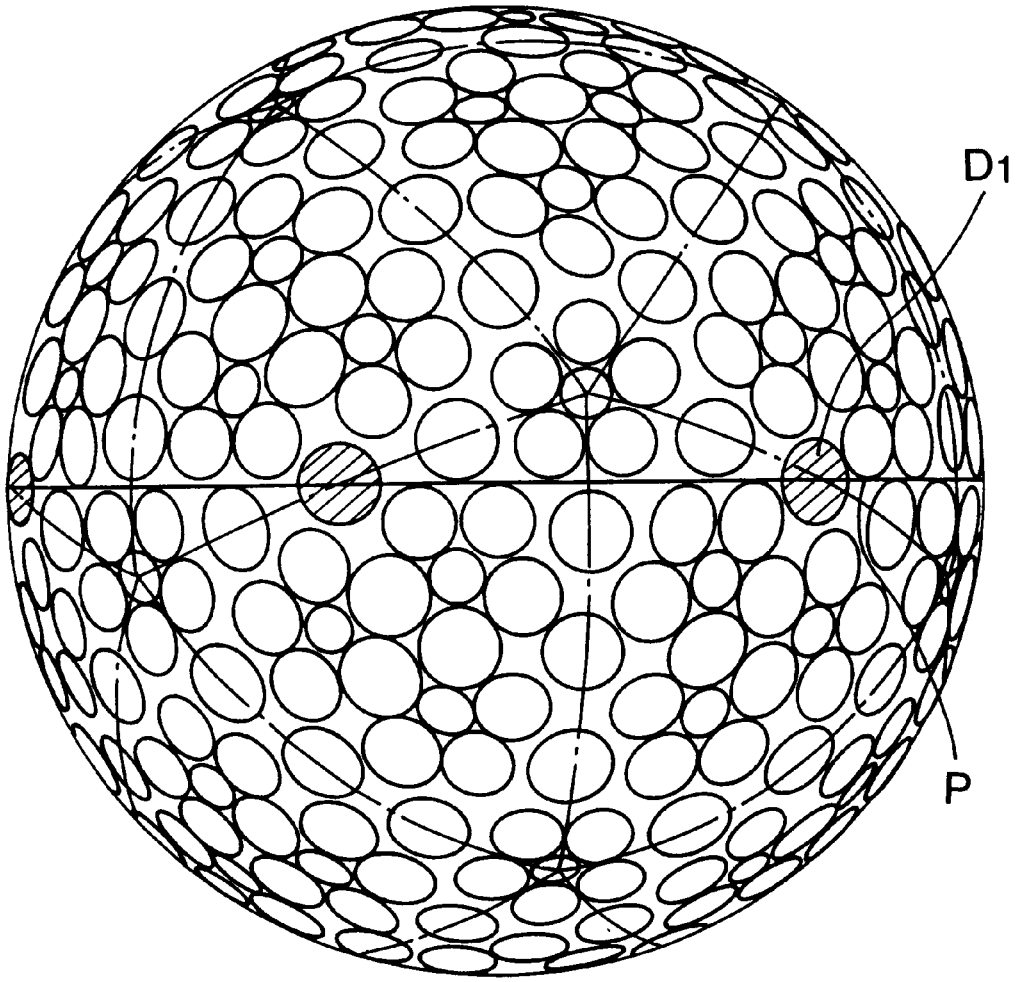
FIG. 6 schematically illustrates the dimples arranged on a comparative golf ball.

Arrangement: icosahedral, FIG. 6

Total number of dimples: 462

Type of dimples: 4 types

Diameter: 2.3 mm, 3.2 mm, 3.4 mm and 3.7 mm

Number of center crossing dimples ($D_1$: diameter 3.7 mm): 6

Dimple surface coverage: 70%

Comparative Example 2

Figure 7:
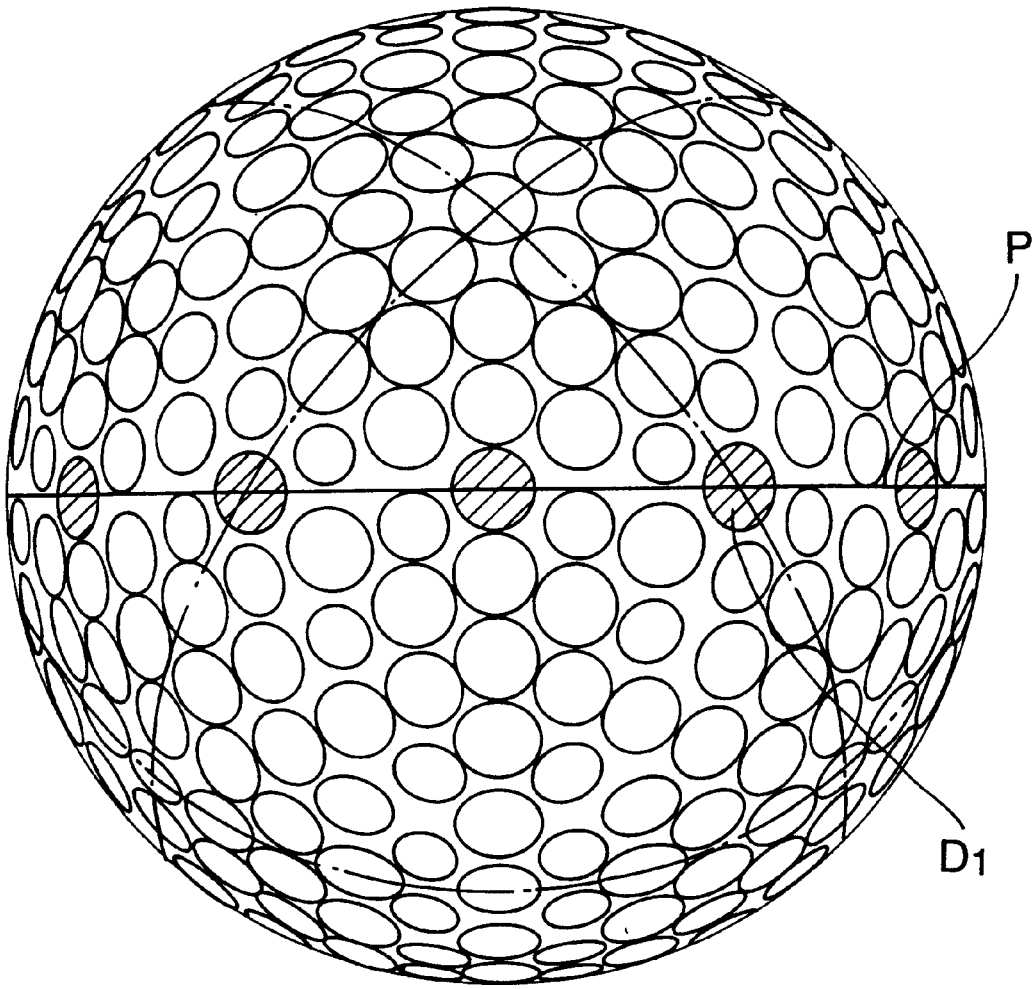
FIG. 7 schematically illustrates the dimples arranged on another comparative golf ball.
Figure 8A:
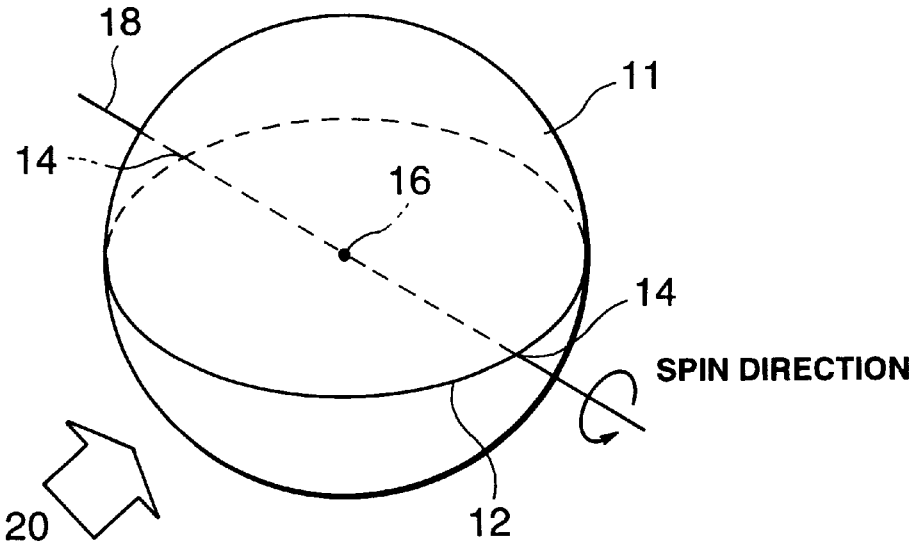
FIG. 8 illustrates the direction in which a golf ball is hit by a club, FIG. 8(A) corresponding to pole hitting and FIG. 8(B) corresponding to seam hitting.
Figure 8B:
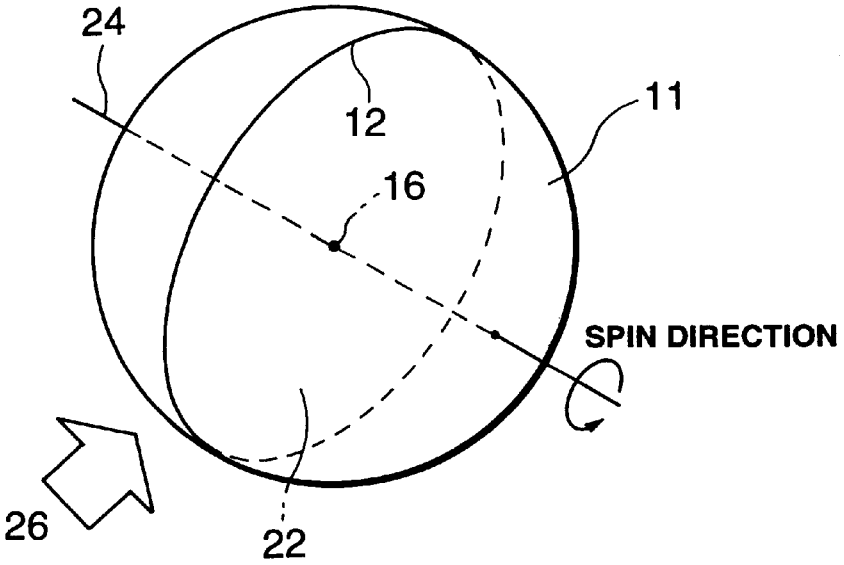

Arrangement: octahedral, FIG. 7

Total number of dimples: 406

Type of dimples: 2 types

Diameter: 3.0 mm and 3.7 mm

Number of center crossing dimples ($D_1$: diameter 3.7 mm): 12

Dimple surface coverage: 70%

Using a swing robot (manufactured by Miyamae K.K.) equipped with a #1 wood, PRO 230 Titan having a loft angle of 11° (Bridgestone Sports Co., Ltd.), the golf balls were hit at a head speed of 45 m/s for measuring flight distance. The results are shown in Table 1.

TABLE 1

| | E1 | E2 | CE1 | CE2 |
|---|---|---|---|---|
| Carry (m) | 215 | 216 | 210 | 209 |
| Total (m) | 231 | 230 | 225 | 224 |

The flying distance upon seam hitting was substantially the same flying distance upon pole hitting in the golf balls of Examples as compared with in the golf balls of Comparative Examples. The golf balls of Examples had a high symmetry.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball which is molded in a mold having a pair of mold sections which are removably joined to define a spherical cavity therein, said golf ball having a parting line at the junction between the mold sections, two to six types of dimples having different diameters within a range of 1.8 to 5 mm arranged on the surface of said golf ball, the dimples being arranged in a polyhedral arrangement selected from octahedral, dodecahedral and icosahedral arrangements so that the golf ball is free of a great circle which does not intersect with the dimples and some of the dimples lie across the parting line, wherein off-center-crossing dimples which would lie across the parting line and whose center would lie outside the parting line are shifted upward or downward from the parting line or reduced in diameter so that the off-center-crossing dimples do not lie across the parting line, and wherein center-crossing dimples whose center lies on the parting line are maintained unchanged and, the surface coverage of dimples is at least 74%.

2. The golf ball of claim 1 wherein the number of the center-crossing dimples is 4 to 20.

3. The golf ball of claim 1 wherein the total number of the dimples is 300 to 600.

4. The golf ball of claim 1 wherein the off-center-crossing dimples are shifted upward or downward from the parting line or reduced in diameter so that the off-center-crossing dimples stand adjacent to the parting line.

5. The golf ball of claim 1 wherein the off-center-crossing dimples are shifted upward or downward from the parting line or reduced in diameter so that the off-center-crossing dimples are substantially tangent to the parting line.

6. The golf ball of claim 1, wherein the depth of said dimples is in the range of 0.05 to 0.3 mm.

7. The golf ball of claim 1, wherein said center-crossing dimples have a diameter in the range of 2 to 5 mm and a depth in the range of 0.1 to 0.3 mm.

8. The golf ball of claim 1, wherein the total number of dimples is in the range of 372 to 500.

9. The golf ball of claim 1, wherein the number of center-crossing dimples is within the range of 6 to 12.

10. A method of arranging two to six types of dimples having different diameters within a range of 1.8 to 5 mm on the surface of a golf ball which is molded in a mold having a pair of mold sections which are removably joined to define a spherical cavity therein so that the surface coverage of the dimples is at least 74%, the golf ball having a parting line formed at the junction between the mold sections and some of the dimples lying across the parting line, the method comprising the steps of:

arranging the dimples in a polyhedral arrangement selected from octahedral, dodecahedral and icosahedral arrangements so that the golf ball is free of a great circle which does not intersect with the dimples, and shifting off-center-crossing dimples which would lie across the parting line and whose center would lie outside the parting line upward or downward from the parting line or reducing the off-center-crossing dimples in diameter so that the off-crossing dimples do not lie across the parting line, while center-crossing dimples whose center lies on the parting line are maintained unchanged.

11. The method of claim 10 wherein the number of the center-crossing dimples is 4 to 20.

12. The method of claim 10 wherein the total number of the dimples is 300 to 600.

13. The method of claim 10 wherein the off-center-crossing dimples are shifted upward or downward from the parting line or reduced in diameter so that the off-center-crossing dimples stand adjacent to the parting line.

14. The method of claim 10 wherein the off-center-crossing dimples are shifted upward or downward from the parting line or reduced in diameter so that the off-center-crossing dimples are substantially tangent to the parting line.

15. The method of claim 10, wherein the depth of said dimples is in the range of 0.05 to 0.3 mm.

16. The method of claim 10, wherein said center-crossing dimples have a diameter in the range of 2 to 5 mm and a depth in the range of 0.1 to 0.3 mm.

17. The method of claim 10, wherein the total number of dimples is in the range of 372 to 500.

18. The method of claim 10, wherein the number of center-crossing dimples is within the range of 6 to 12.

* * * * *